US011142975B2

(12) United States Patent
Hayward

(10) Patent No.: US 11,142,975 B2
(45) Date of Patent: Oct. 12, 2021

(54) SLIP AND CONE ARRANGEMENT

(71) Applicant: Doug Hayward, Edmonton (CA)

(72) Inventor: Doug Hayward, Edmonton (CA)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/722,849

(22) Filed: Dec. 20, 2019

(65) Prior Publication Data

US 2021/0189816 A1 Jun. 24, 2021

(51) Int. Cl.
*E21B 23/01* (2006.01)
*E21B 33/129* (2006.01)

(52) U.S. Cl.
CPC ..... *E21B 23/01* (2013.01); *E21B 33/129* (2013.01)

(58) Field of Classification Search
CPC ..... E21B 33/129; E21B 33/1291; E21B 33/1292; E21B 33/1293; E21B 23/01
See application file for complete search history.

(56) References Cited

U.S. PATENT DOCUMENTS 3,710,866 A * 1/1973 Pitts ..... E21B 33/1291 166/216
4,340,116 A * 7/1982 Weise ..... E21B 23/01 166/215
4,750,559 A * 6/1988 Greenlee ..... E21B 23/01 166/216
4,750,563 A * 6/1988 Baugh ..... E21B 23/01 166/216
5,174,397 A * 12/1992 Currington ..... E21B 23/01 166/138
6,073,693 A * 6/2000 Aldridge ..... E21B 23/01 166/217
6,213,204 B1 * 4/2001 Doane ..... E21B 33/1293 166/134
6,241,017 B1 * 6/2001 Doane ..... E21B 33/1293 166/134
8,770,276 B1 * 7/2014 Nish ..... E21B 33/1291 166/138
9,416,608 B2 * 8/2016 Ruffo ..... E21B 33/129
10,024,125 B2 * 7/2018 Webster ..... E21B 23/01
10,024,134 B2 * 7/2018 Webster ..... E21B 33/1293
2017/0044859 A1 * 2/2017 Blair ..... E21B 33/1292
2017/0101836 A1 * 4/2017 Webster ..... E21B 33/134
2019/0338605 A1 * 11/2019 Anderson ..... E21B 33/129

* cited by examiner

*Primary Examiner* — Frederick L Lagman
(74) *Attorney, Agent, or Firm* — Cantor Colburn LLP

(57) ABSTRACT

A slip and cone arrangement including a mandrel having a groove, the groove having a run in end and a set end, a deepest portion of the groove on the run in end having a distance from a longitudinal axis of the mandrel that is less than a deepest portion of the groove on the set end; and a slip disposed in the groove, the slip having a radially inward surface having a convex portion in nested contact with the groove.

14 Claims, 5 Drawing Sheets

SLIP AND CONE ARRANGEMENT

BACKGROUND

In the resource recovery industry there is often need to anchor various tools or strings of tubing into place. Commonly, a frustoconical surface is used to radially outwardly displace one of more slips pursuant to axial relative movement between the two where distance therebetween is reduced. As the one or more slips move radially outwardly, they come into contact with another structure radially outwardly positioned relative to the slip and cone arrangement, that often being a casing. This type of arrangement has a long history of use and generally works well although failures do occur occasionally. The art would well receive alternatives that increase reliability.

SUMMARY

A slip and cone arrangement including a mandrel having a groove, the groove having a run in end and a set end, a deepest portion of the groove on the run in end having a distance from a longitudinal axis of the mandrel that is less than a deepest portion of the groove on the set end; and a slip disposed in the groove, the slip having a radially inward surface having a convex portion in nested contact with the groove.

A slip and cone arrangement including a mandrel having a cone exhibiting a smooth curved concave groove therein; and a slip having a radially inward surface being convex and complementary to the concave groove.

A slip including an outside surface having a convex curvature; and a radially inward surface includes a portion that is convex.

A mandrel for a slip and cone arrangement including a cone having a groove therein, the groove receptive to a slip having an inner surface with a convex portion nestable with the groove.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
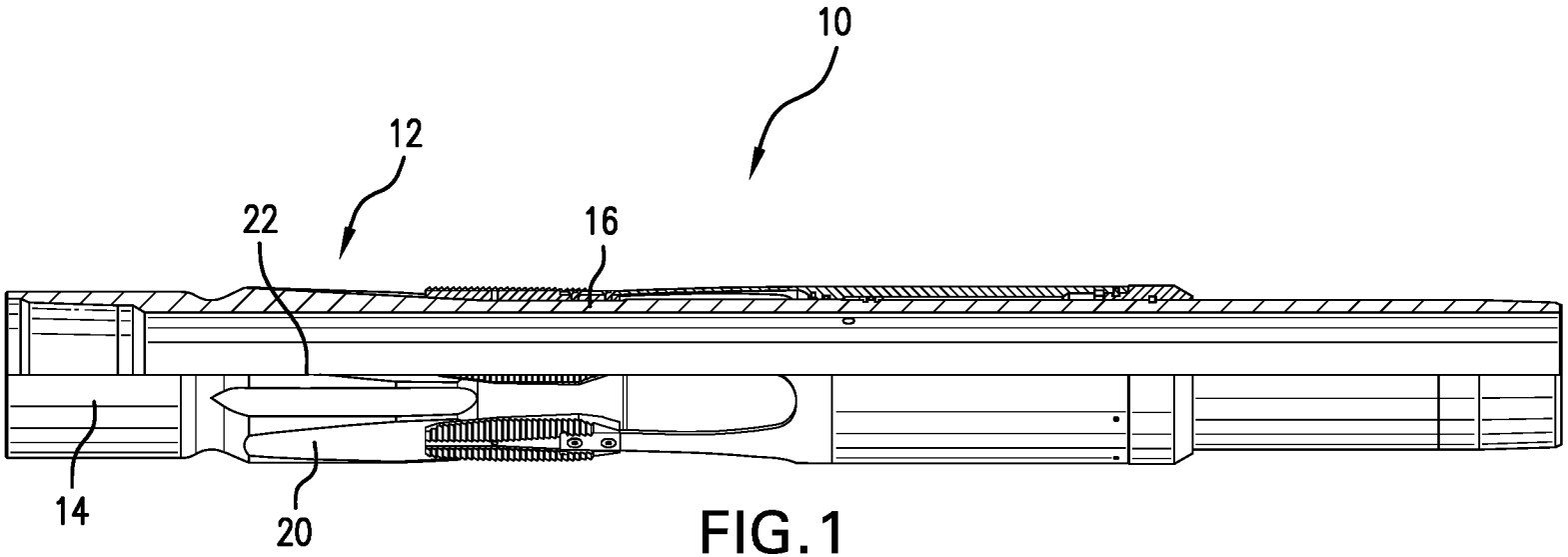
FIG. 1 is a three-quarter section view of a slip and cone arrangement as disclosed herein in a run in position.
Figure 6:
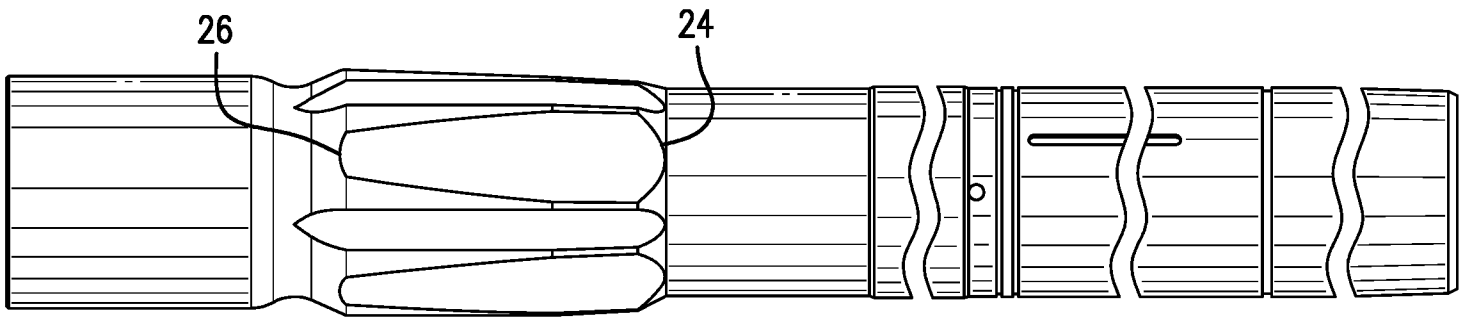
FIG. 6 is a side view of the Mandrel alone to illustrate the groove geometry.

Referring to FIG. 1, a three-quarter section view of a slip and cone arrangement 10 herein in a run in position is illustrated. Describing a cone 12 of the arrangement 10 first, a mandrel 14 exhibits a smaller diameter area 16 where a number of slips 18 reside when the arrangement 10 is in the run in position. The mandrel 14 then grows in outside diameter toward the left of the smaller diameter area 16 in the Figure. This will be understood to be the cone 12. Cone 12 is quite different than ordinary cones in the industry however. Cone 12 is constructed, whether by subtractive machining or additive manufacture with a number of grooves 20 (one or more) therein for slips 18. Referring to FIG. 6, it will be appreciated that each of the grooves 20 is of concave shape and in an embodiment exhibits a smooth curved concave shape. Further the groove 20 may display reducing circumferential dimension when measured circumferentially of the cone 12 along the length of the groove. Stated alternatively, if one were to measure how wide the groove is by stretching a tape measure around the circumference of the cone 12, the measurement at a run in end 24 will be wider than the measurement at a set end 26 of the groove. In one embodiment this is in part because the groove 20 is angled relative to a longitudinal axis 22 of the mandrel. If less of the concave geometry is in the material of the mandrel 14, the measurement as described would necessarily be smaller. The groove is so constructed so that it acts as a cone to radially displace the slip 18 upon longitudinal relative movement between the cone 12 and slip 18. The angle results in a deepest portion of the groove at end 24 being a smaller distance from axis 22 than a deepest portion of groove 20 on end 26. It will be appreciated that this geometry moves the slip 18 radially outwardly upon motion from the run in end 24 to the set end 26 of the groove 20. In embodiments, the groove is angled relative to the axis 22 by about 1 to about 15 degrees and in a specific embodiment by about 3 degrees. "About" in the context hereof is intended to include manufacturing tolerances and up to 10 percent variation in stated numbers. The cone 12 may also include optional flow channels 28 that may (at their deepest points) be of the same radial distance from axis 22 along their length or otherwise, as desired.

Referring to FIGS. 1, 7, 8 and 9, the slip 18 geometry is disclosed. It will be appreciated that at an outside surface 30 of the slip 18 there is a convex curvature and in embodiments a number of teeth 32 being disposed thereon. In some cases, the curvature of surface 30 will be selected to coincide with the inside diameter curvature of the tubular member or structure in which the slip and cone arrangement is intended to set. For example, if the arrangement 10 is to be set in a casing, of a particular ID, then the curvature of the surface 30 may be selected to match that casing ID thereby encouraging even face contact for the slip 18 with the casing. It is to be understood that this feature is not required but rather optional.

Figure 7:
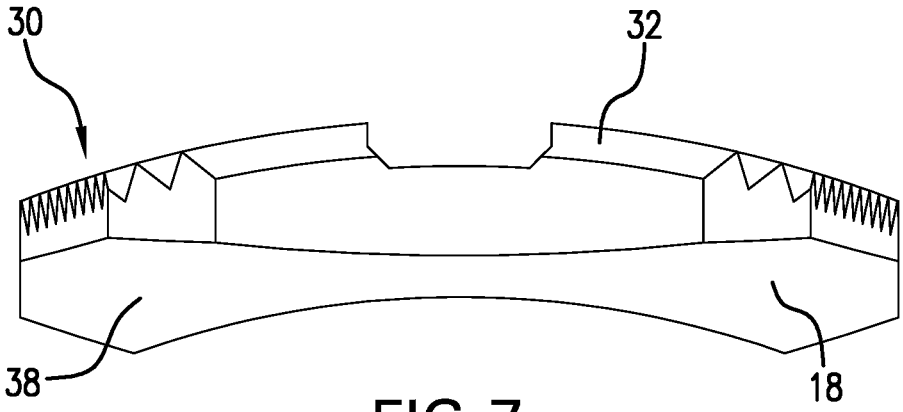
FIG. 7 is an end view of a trailing edge of the slip.
Figure 8:
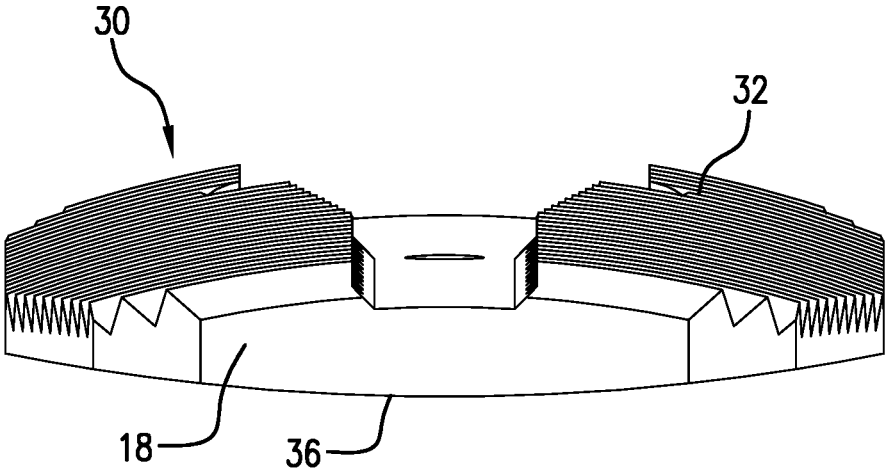
FIG. 8 is an end view of a leading end of the slip.
Figure 9:
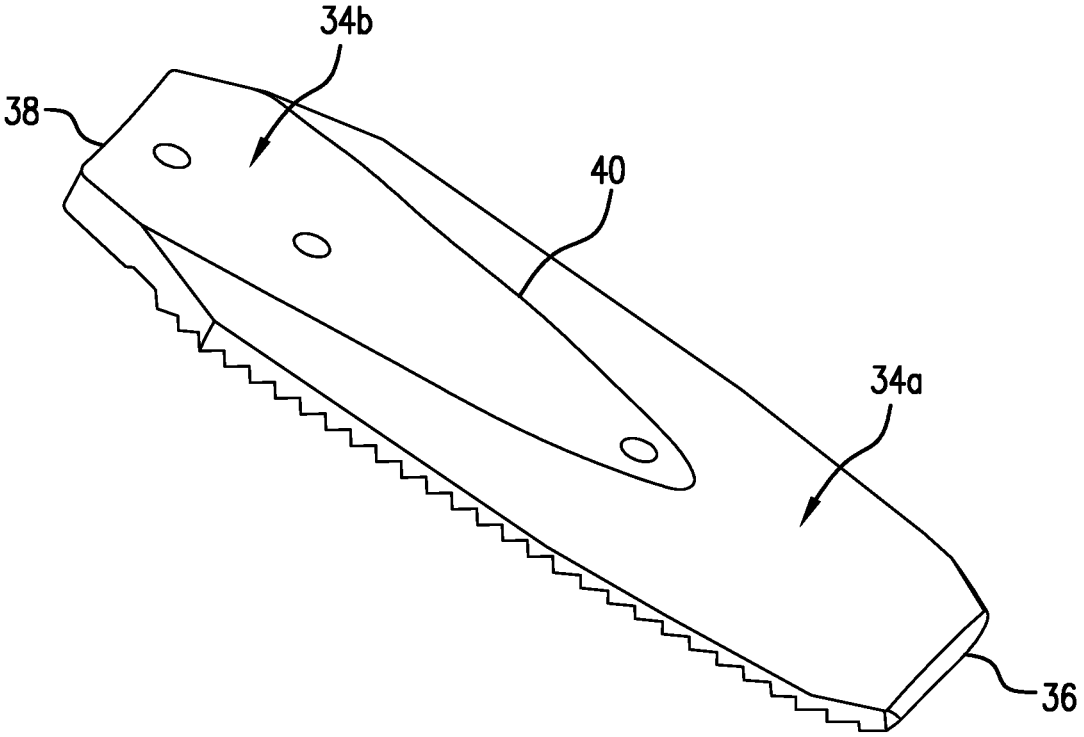
FIG. 9 is a view showing the geometry of the bottom surface of the slip.

Referring to FIGS. 7, 8 and 9, at a radially inward surface 34 of the slip 18, the geometry is complex. In describing the geometry it will be helpful to note that each slip 18 will have a leading end 36 and a trailing end 38. Toward the leading end 36 the surface 34 includes a convex portion 34*a* whereas toward the trailing end 38, the surface 34 includes a concave portion 34*b*. In embodiments, the transition from convexity to concavity may be sharp while in others it may be more gradual. In either case, the transition will be on a curve 40 that can be seen in FIG. 9. The curve is parabolic in an embodiment. Surface 34*b* (the concave portion) allows the slip 18 to nest closely to the mandrel small diameter area 16 and that in turn helps with ensuring the drift diameter of the arrangement is not dictated by surface 30 of the slips 18 but rather some other portion of the arrangement. In other words, the concave portion 34*b* helps the slips remain sub drift diameter during run in. The trailing end 38 of the slip includes both convex portion 34*a* and concave portion 34*b*, allowing contact with groove 20 at larger casing ID ranges. In other words, the parabolic arrangement of the surfaces allows the slip to remain sub drift during run in but retain contact with the cone grooves at all casing ID ranges, resulting in a more structurally efficient configuration. 34*a* being convex, nests with the groove 20 and ensures even loading of the slip 18 against the cone 12. Even loading means that the slip does not have to flex to conform and does not have areas of much higher stress in conventional slips such as on the longitudinal edges of the slip. Additionally, due to the groove and convexity nesting, the slip has significantly greater rotational position retention than prior art slips that can spin around the cone and possibly become misaligned resulting in set failure. The groove and convexity nesting as disclosed herein ensures proper retention of slips during running and position during setting.

Figure 2:
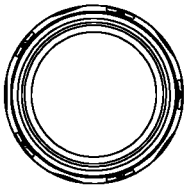
FIG. 2 is an end view of FIG. 1.
Figure 3:
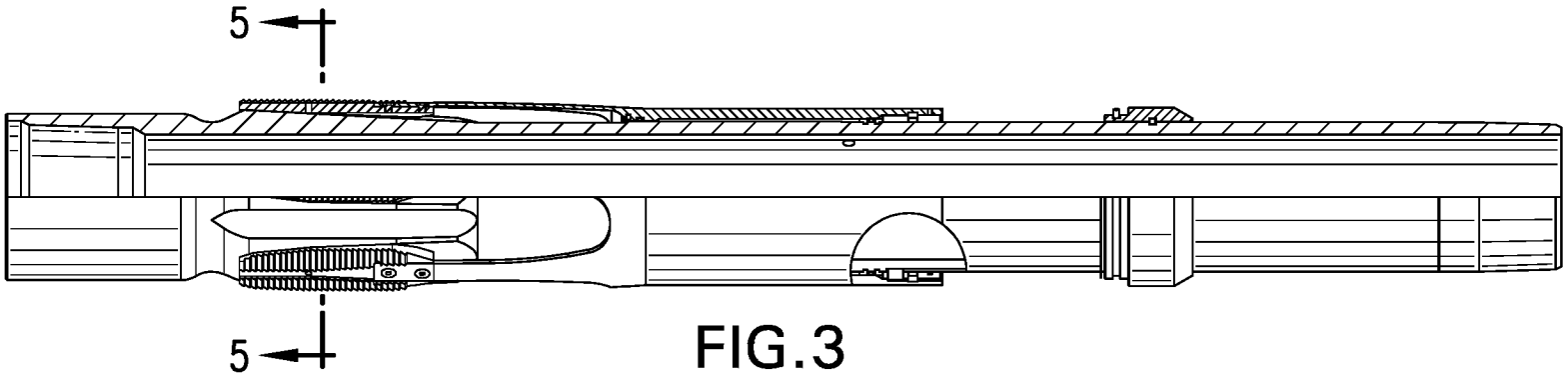
FIG. 3 is a three-quarter section view of a slip and cone arrangement as disclosed herein in a set position.
Figure 5:
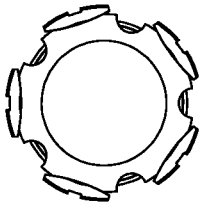
FIG. 5 is cross sectional view of FIG. 3 taken along section line 5-5.
Figure 4:
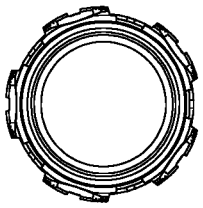
FIG. 4 is an end view of FIG. 3.

Having discussed the components, a review of FIGS. 1-5 simultaneously will provide one of skill in the art a very good understanding of the operation of the arrangement 10 as FIGS. 1 and 3 illustrated the arrangement 10 in the run in and set positions respectively. FIGS. 2 and 4 show the end views of the positions illustrated in FIGS. 1 and 3, respectively and FIG. 5 is a cross section taken along line 5-5 to show the mid slip view for an understanding of the nesting of the convex portion 34*a* of slips 18 with the concavity of the groove 20. It will be evident from this view the stress risers are eliminated, load is distributed and the slips 18 are well supported. The view also provides support for the better ability of the arrangement 10 to maintain the slips in the proper position since it would be quite difficult for them to become disengaged from the concavity they ride in on the cone 12.

Set forth below are some embodiments of the foregoing disclosure:

Embodiment 1: A slip and cone arrangement including a mandrel having a groove, the groove having a run in end and a set end, a deepest portion of the groove on the run in end having a distance from a longitudinal axis of the mandrel that is less than a deepest portion of the groove on the set end; and a slip disposed in the groove, the slip having a radially inward surface having a convex portion in nested contact with the groove.

Embodiment 2: The arrangement as in any previous embodiment wherein the slip radially inward surface 34 further includes a concave portion.

Embodiment 3: The arrangement as in any previous embodiment wherein a transition region between the convex portion and the concave portion is curved.

Embodiment 4: The arrangement as in any previous embodiment wherein a transition region between the convex portion and the concave portion is parabolic.

Embodiment 5: The arrangement as in any previous embodiment wherein the convex portion nests with a small diameter portion of the mandrel in a run in position.

Embodiment 6: The arrangement as in any previous embodiment wherein the slip includes teeth on an outside surface thereof.

Embodiment 7: The arrangement as in any previous embodiment wherein the slip outside surface is curve matched to a structure in which the arrangement is intended to be set.

Embodiment 8: The arrangement as in any previous embodiment wherein the groove includes a circumferential measurement at the set end that is smaller than a circumferential measurement at the run in end.

Embodiment 9: The arrangement as in any previous embodiment wherein the mandrel further includes a flow channel.

Embodiment 10: A slip and cone arrangement including a mandrel having a cone exhibiting a smooth curved concave groove therein; and a slip having a radially inward surface being convex and complementary to the concave groove.

Embodiment 11: A slip including an outside surface having a convex curvature; and a radially inward surface includes a portion that is convex.

Embodiment 12: The slip as in any previous embodiment wherein the convex portion is complementary to a cone with which the slip is to be nested during use.

Embodiment 13: The slip as in any previous embodiment wherein the inward surface further includes a portion that is concave.

Embodiment 14: A mandrel for a slip and cone arrangement including a cone having a groove therein, the groove receptive to a slip having an inner surface with a convex portion nestable with the groove.

Embodiment 15: The mandrel as in any previous embodiment wherein the groove is a smooth curved concave geometry.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A slip and cone arrangement comprising:

a mandrel having a groove, the groove having a run in end and a set end, a deepest portion of the groove on the run in end having a distance from a longitudinal axis of the mandrel that is less than a deepest portion of the groove on the set end; and a slip disposed in the groove, the slip having a radially inward surface having a convex portion in nested contact with the groove.

2. The arrangement as claimed in claim 1 wherein the slip radially inward surface 34 further includes a concave portion.

3. The arrangement as claimed in claim 2 wherein a transition region between the convex portion and the concave portion is curved.

4. The arrangement as claimed in claim 2 wherein a transition region between the convex portion and the concave portion is parabolic.

5. The arrangement as claimed in claim 1 wherein the convex portion nests with a small diameter portion of the mandrel in a run in position.

6. The arrangement as claimed in claim 1 wherein the slip includes teeth on an outside surface thereof.

7. The arrangement as claimed in claim 1 wherein the slip outside surface is curve matched to a structure in which the arrangement is intended to be set.

8. The arrangement as claimed in claim 1 wherein the groove includes a circumferential measurement at the set end that is smaller than a circumferential measurement at the run in end.

9. The arrangement as claimed in claim 1 wherein the mandrel further includes a flow channel.

10. A slip and cone arrangement comprising:

a mandrel having a cone exhibiting a frustoconical outside surface and exhibiting a smooth curved concave groove therein, the groove being frustoconically oriented relative to a longitudinal axis of the mandrel; and a slip having a radially inward surface being convex and complementary to the concave groove.

11. A slip comprising:

an outside surface a mandrel; having a convex curvature; and a radially inward surface including a portion that is convex and complementary to a cone exhibiting a groove being frustoconically oriented relative to a longitudinal axis of a mandrel with which the slip is to be nested during use.

12. A slip comprising:

an outside surface having a convex curvature; and a radially inward surface including a portion that is convex wherein the inward surface further includes a portion that is concave.

13. A mandrel for a slip and cone arrangement comprising:

a cone exhibiting a frustoconical outside surface and having a groove therein, the groove being frustoconically oriented relative to a longitudinal axis of the mandrel, the groove receptive to a slip having an inner surface with a convex portion nestable with the groove.

14. The mandrel as claimed in claim 13 wherein the groove is a smooth curved concave geometry.

* * * * *